US008839705B2

(12) United States Patent
Chiappini et al.

(10) Patent No.: US 8,839,705 B2
(45) Date of Patent: Sep. 23, 2014

(54) MECHANISM FOR SETTING A FUSE

(75) Inventors: Andrea Chiappini, La Spezia (IT); Gianluca Biselli, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 620 days.

(21) Appl. No.: 13/115,739

(22) Filed: May 25, 2011

(65) Prior Publication Data

US 2011/0290100 A1 Dec. 1, 2011

(30) Foreign Application Priority Data

May 26, 2010 (IT) ..... TO2010A0439

(51) Int. Cl.
*F42C 17/00* (2006.01)

(52) U.S. Cl.
CPC ..... *F42C 17/00* (2013.01)
USPC ..... 89/6.5; 89/6

(58) Field of Classification Search
USPC ..... 89/6, 6.5
See application file for complete search history.

(56) References Cited

U.S. PATENT DOCUMENTS 2,295,573 A * 9/1942 Fontaine ..... 89/6
2,442,842 A 6/1948 Cole et al.
2,451,764 A * 10/1948 Molins et al. ..... 89/6
2,887,011 A * 5/1959 Harvey et al. ..... 89/6.5
3,710,677 A 1/1973 Mayer
6,289,780 B1 * 9/2001 Heldmann ..... 89/6.5

FOREIGN PATENT DOCUMENTS

| | | |
|---|---|---|
| CH | 503 254 | 3/1971 |
| DE | 1578 509 | 7/1970 |
| GB | 808480 | 2/1959 |

OTHER PUBLICATIONS

Italian Search Report from Application No. IT TO20100439 dated Jan. 20, 2011.

* cited by examiner

*Primary Examiner* — Benjamin P Lee
(74) *Attorney, Agent, or Firm* — Merchant & Gould P.C.

(57) ABSTRACT

A mechanism for setting a fuse, applied to the structure of a firearm 5, includes a setting device 2, adapted to program the fuse, the setting device 2 being fixed to a support structure 13 and having a reference portion 21 and a setting portion 22, rotating around the longitudinal axis of the fuse, adapted to set the fuse of a cartridge. The setting mechanism includes a support structure, the support structure supports a control device of the position of the setting device 2, formed by a movable equipment 31 from an actuator of a vertical movement 34 and from an actuator of a horizontal movement 35. The actuators are able to move along a horizontal "X"-axis of the support structure, along a vertical "Z"-axis, the same movable equipment 31 for the positioning of the setting device 2, with respect to the cartridge, kept in a predetermined position.

18 Claims, 5 Drawing Sheets

MECHANISM FOR SETTING A FUSE

This application claims benefit of Serial No. TO 2010 A 000439, filed 26 May 2010 in Italy and which application is incorporated herein by reference. To the extent appropriate, a claim of priority is made to the above disclosed application.

BACKGROUND OF THE INVENTION

The present invention refers to a mechanism for setting fuses for ammunition.

The setting device is normally a mechanic device adapted to actuate the time fuses in the ammunition.

The time fuses are typically placed on the frontal part of the ammunition, permitting the actuation of the explosive charge at the inside of the cartridge, by determining the burst time.

More precisely, these fuses comprise two sections, a fixed one integral with the cartridge, and a movable one able to rotate with respect to the fixed one, around the axis of the ammunition; furthermore each section comprises a cavity, adapted to retain parts during the relative movement.

Such relative movement permits to set the time between the shooting moment of the ammunition and the moment in which the fuse causes the explosion of the charge at the inside of the cartridge, by means of a suitable inner timing mechanism.

Setting devices of a completely mechanical type are known, providing a substantial encumbrance, by making such device inefficient. With the introduction of electric and electronic systems, more and more compact hybrid graduation systems with better performances are developing, due to the introduction of electronic systems for actuation and control.

The setting devices are normally used on ammunition used in warships such as cruisers or similar naval means needing such system, in order to program the fuses and so the burst of such ammunition.

Normally the fuses produced nowadays provide a preferential axial development, with respect to the longitudinal axis of the ammunition, for the particular naval complexes on which they were installed, by occupying a great space.

The known method of setting the fuse essentially comprises the following steps: positioning the setting device in the vicinity of the fuse; engaging two teeth of the driving setting device in two respective cavities present on the aforementioned sections; relative rotation of the two sections mounted on the fuse.

The engagement step of the driving teeth consists in two operations: identifying the reference or zero position on the fixed section of the fuse; rotation until the tooth of a lever engages with the cavity present on the movable section of the fuse.

SUMMARY OF THE INVENTION

The present invention aims to obviate the aforementioned problems, by realizing a hybrid setting mechanism for a fuse, adapted to be flexible, rapid and accurate.

Furthermore, such mechanism is able to take different positions with respect to the position of the fuse, in order to fulfill its function also in narrow zones, as in this way the necessary maneuvering space is reduced.

An aspect of the present invention concerns an innovative setting mechanism for fuses.

BRIEF DESCRIPTION OF THE DRAWINGS

The characteristics and advantages of such setting device will be clearer and evident by the following description of an embodiment, with reference to the annexed Figures, which in particular show:

FIG. 1A the setting mechanism according to the present invention: FIG. 1B the mechanism of FIG. 1A applied to a firearm;

DETAILED DESCRIPTION

Figure 1A:
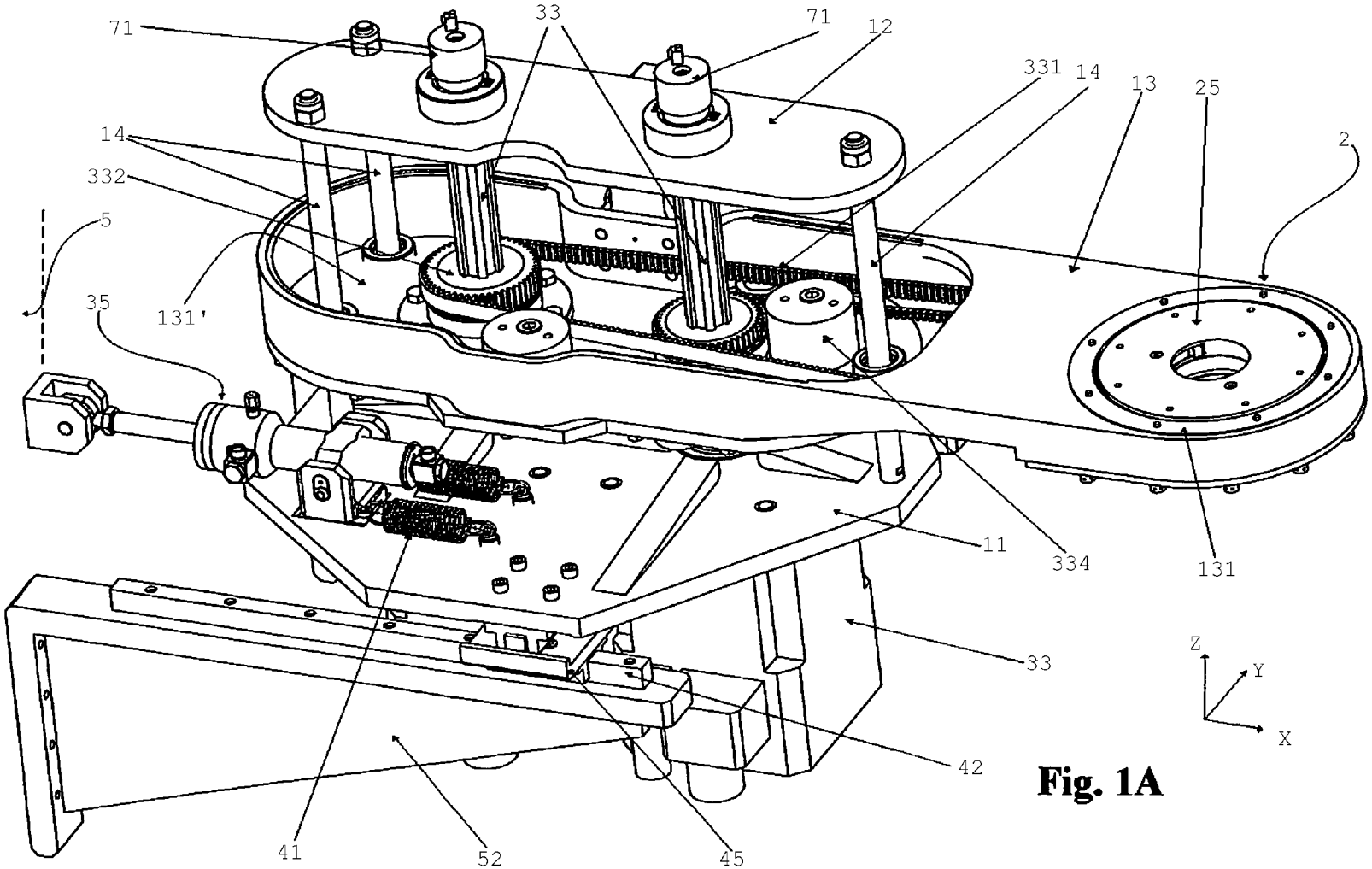
FIGS. 1A and 1B respectively show.
Figure 2:
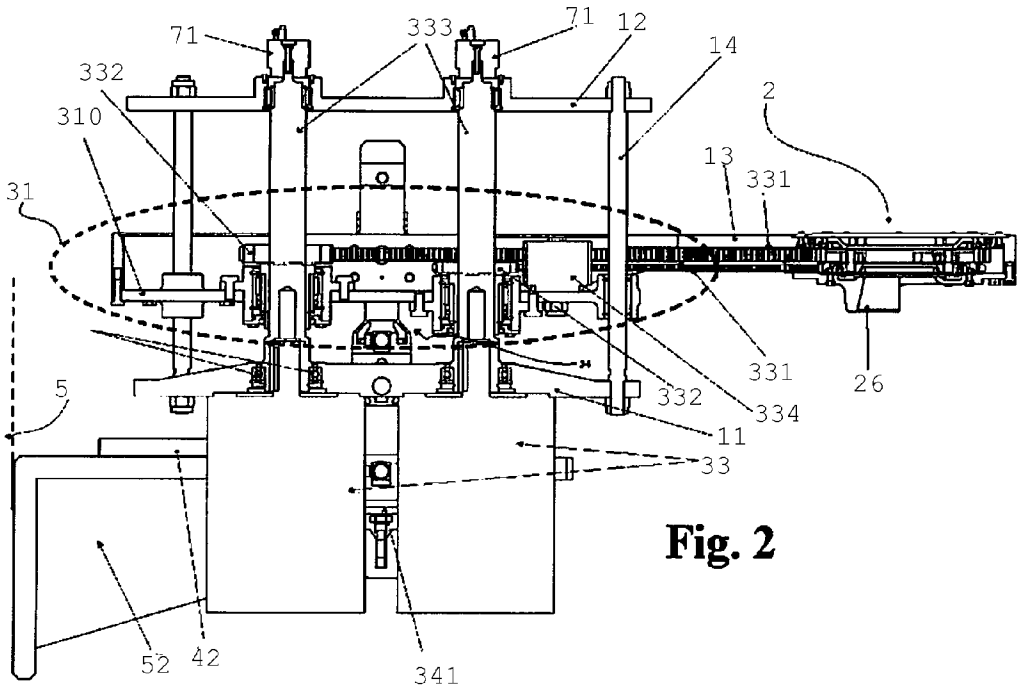
FIG. 2 shows a section on the vertical plane of the setting mechanism in FIG. 1, in particular in the control device.
Figure 1B:
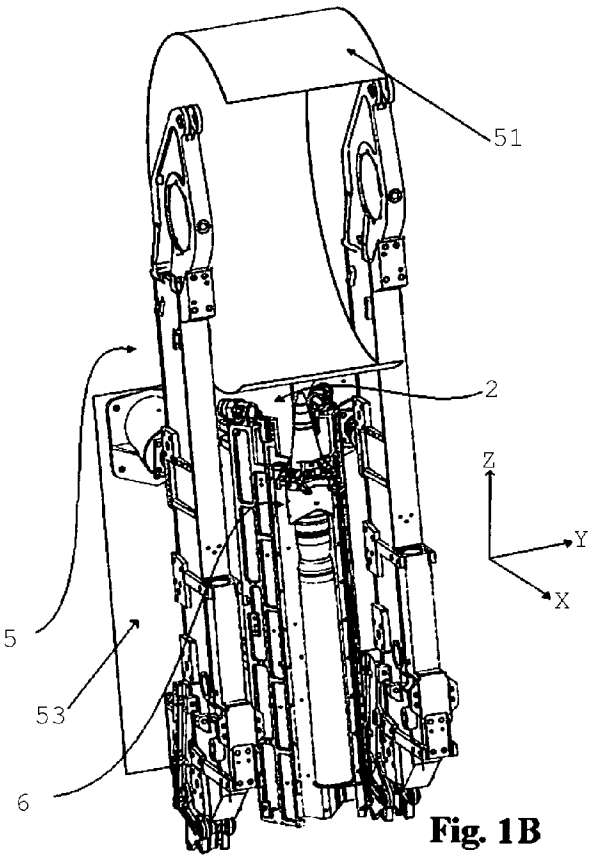
Figure 3:
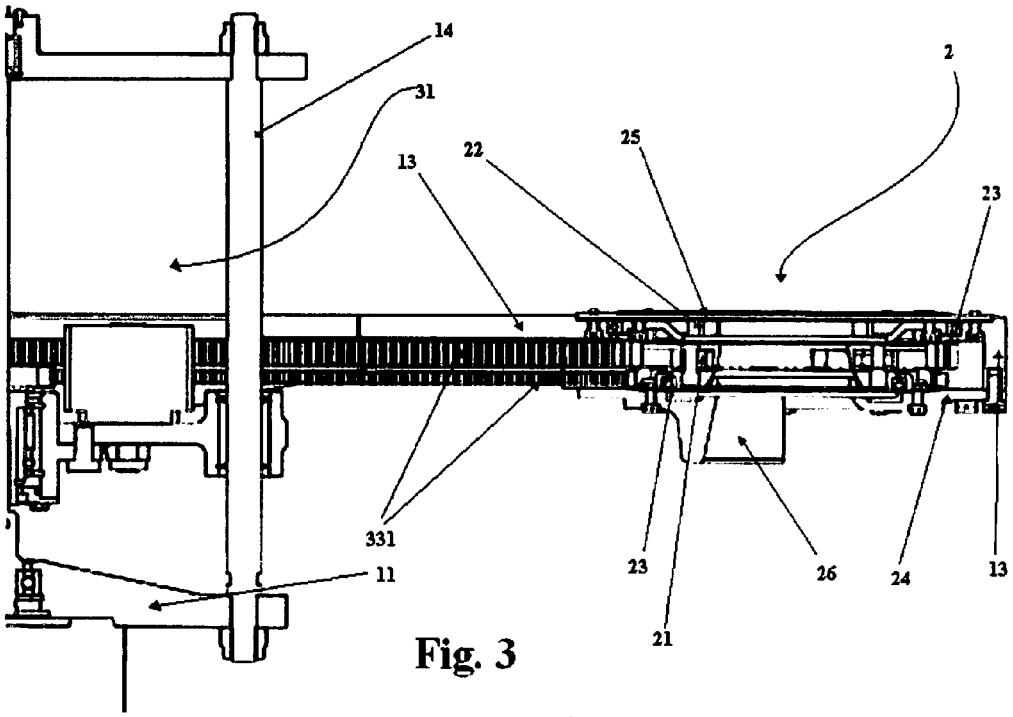
FIG. 3 shows a section on the vertical plane of the setting device in the setting mechanism according to the present invention.
Figure 4:
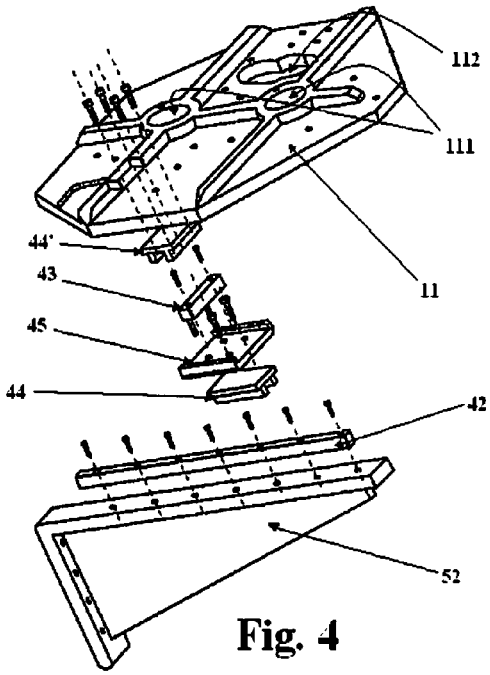
FIG. 4 shows an exploded view of the plurality of sledges and guides placed under the engine plate.
Figure 5:
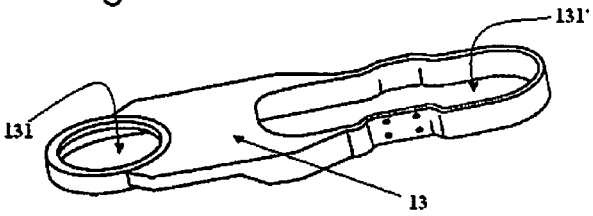
FIG. 5 shows in particular the support structure in which the setting device is positioned.
Figure 6:
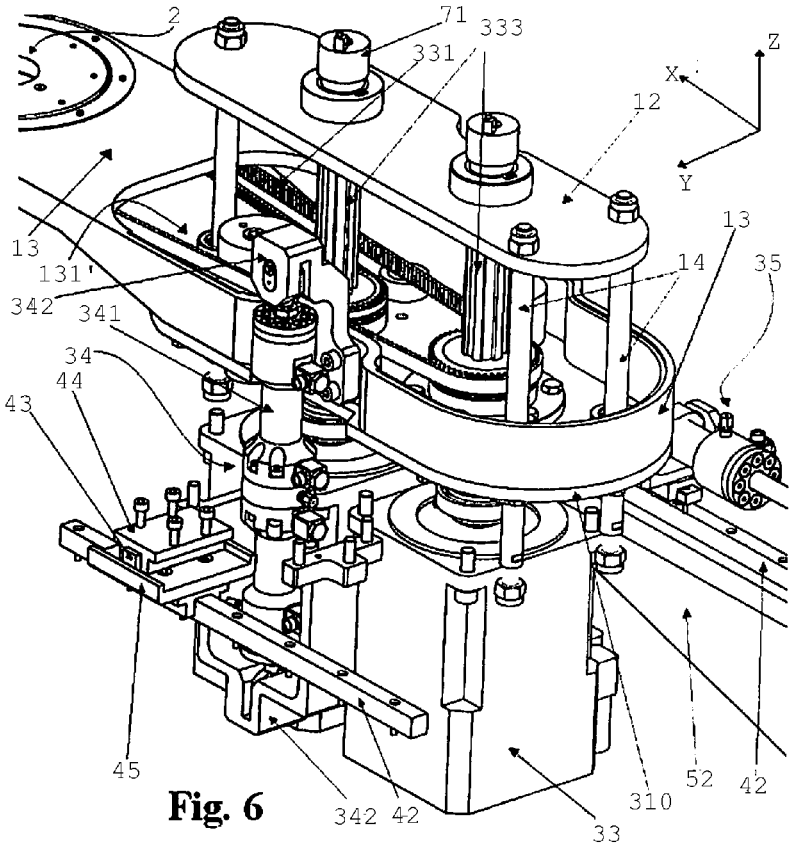
FIG. 6 shows, in a perspective view, the actuator of a vertical movement.
Figure 7:
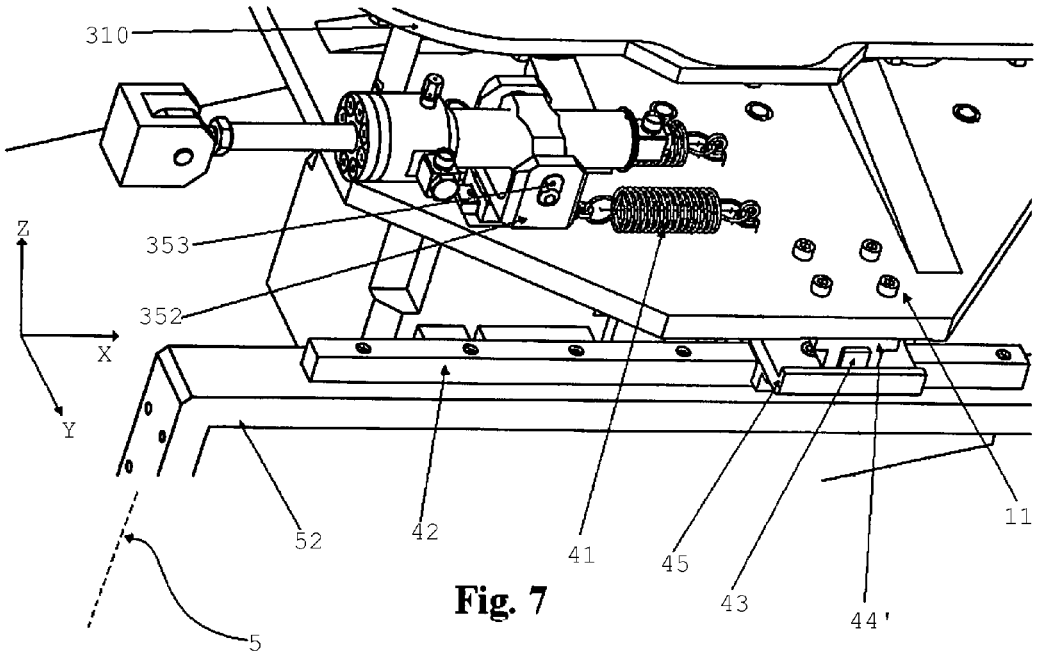
FIG. 7 shows the actuator of a longitudinal movement in a perspective view.
Figure 8:
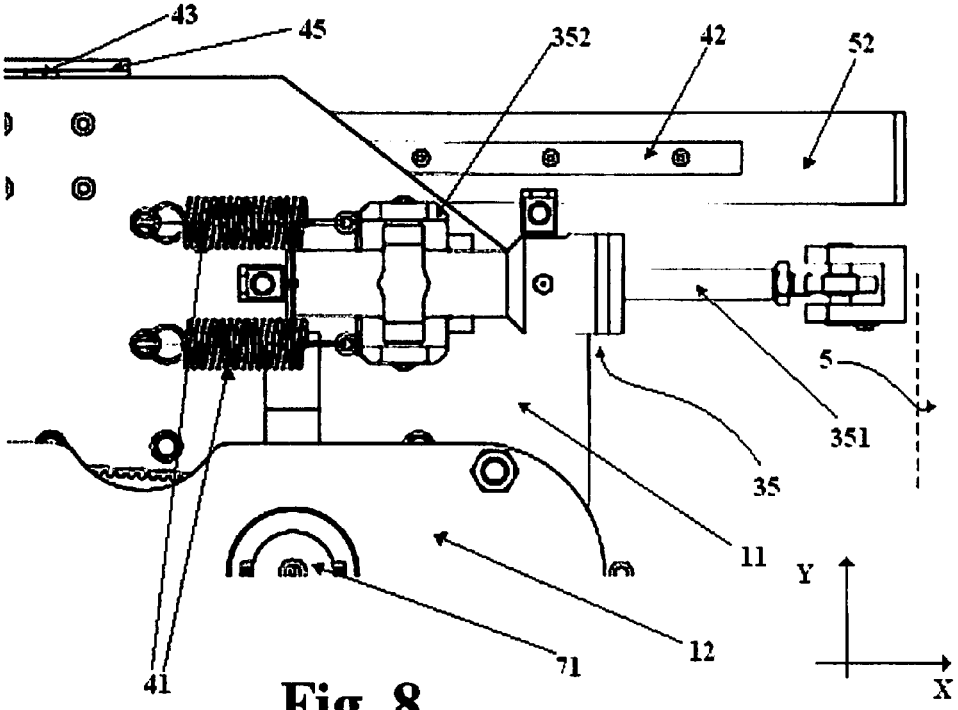
FIG. 8 shows the actuator of a longitudinal movement and a part of the mechanism for recovering errors according to the present invention, in a top view.

With reference to the cited Figures, the setting mechanism of a fuse according to the present invention is applied to the structure of a firearm 5. Such mechanism comprises a setting device 2, fixed to a support structure 13, comprising a reference portion 21 and a setting portion 22, rotating around the longitudinal axis of the ammunition and adapted to set the fuse of the cartridge.

Such mechanism comprises a support structure, supporting a control device of the position of setting device 2, formed by a movable equipment 31, by an actuator for vertical movement 34 and by an actuator for horizontal movement 35.

Such actuators are adapted to be handled along horizontal "X"-axis of the support structure and of movable equipment 31, associated with setting device 2, along vertical "Z"-axis of the same movable equipment 31 for positioning setting device 2 with respect to the cartridge, which is kept in a predetermined position by a mechanism 6 for retaining cartridges.

The setting mechanism also comprises a mechanism for recovering errors, adapted to correctly position setting device 2 on "XY"-plane in the case of a non-alignment of the cartridge from its ideal axis.

The setting mechanism preferably takes three distinct positions, adapted to set the fuse without hindering the movement of the cartridge in the path comprised among the various steps of the loading and shooting system of the cartridges.

Such positions taken by the setting mechanism are the following:

- a waiting position, in which such mechanism waits for the correct positioning of the cartridge and for blocking of the cartridge itself by means of a retaining mechanism of cartridges 6;
- a working position, in which setting device 2 sets the fuse;

a disengaging and retracting position, in which the setting mechanism disengages the cartridge and moves away from it, by allowing the operation to the other operating steps of the naval complex.

Such consecutive positions permit to the setting mechanism to rapidly set the fuses of the cartridges, without interfering with the other working steps of the naval complex, even if the space in which such mechanism is positioned has reduced dimensions.

In the following descriptive and not limitative embodiment of the present invention, the setting mechanism of the fuse is preferably positioned in the structure of firearm 5 covered by a gun carriage 53 of the firearm, positioned under a movable shield 51 and fixed to the structure of firearm 5 by means of at least one support flange 52.

The cartridge coming from a lifting system adapted to bring the cartridges in the vicinity of the firearm is positioned for setting the fuse. Such cartridge is kept in such a position from retaining mechanism 6 of the cartridges, comprising a loading arm 61, adapted to position the cartridge itself, and a plurality of lifters 62, adapted to stop the cartridge in the correct position during its lifting.

The support structure of the setting mechanism comprises a motor plate 11 to which at least two engines 33, preferably by screws, are fixed, adapted to rotate setting device 2, with a limit plate 12, facing and superimposed to motor plate 11, between which it moves vertically with respect to movable equipment 31.

Motor plate 11 and limit plate 12 are spaced and kept in such position by a plurality of columns 14.

Said columns 14 are preferably metal cylindrical bars, threaded at the end and fixed to motor plate 11 and to limit plate 12 preferably by means of bolts.

The support structure also comprises support structure 13, preferably metallic and with an elongated shape, positioned between the two aforementioned plates and fixed to movable equipment 31, which can slide vertically.

Such support structure 13 comprises at least two slots 131 and 131', preferably positioned at the two ends of structure 13, in which setting device 2 and a part of the control device are respectively positioned.

Setting device 2, as aforementioned, is positioned at the inside of slot 131 of support structure 13, and it comprises reference portion 21, integral with support structure 13, and setting portion 22, stacked and aligned with reference portion 21, adapted to make the setting of the fuse.

Reference portion 21 and setting portion 22 are essentially ferrule-shaped and are inserted inside slot 131, so to rotate independently one from the other, due to a plurality of bearings. In particular, the rotation of reference portion 21 and of setting portion 22 is made by at least two preferably toothed belts 331, each of them directly connected with its respective portion, which transfer the motion from the electrical assigned motors 33.

Such support structure 13 also performs a covering function for such belts 331, which slide inside a channel or carter, from slot 131 to slot 131', set in such structure 13.

The shape of support structure 13 permits to withstand the mechanical stresses, due both to the handling of the setting mechanism during the various aforementioned steps and the various loads supported by such structure 13.

Said loads can be both intrinsic to the operation and structure, and exceptional due to the malfunctioning of the chain mechanism inside the firearm, such as for example the breaking of one of lifters 62.

On setting portion 22 a cover 25 is present, adapted to block and protect the portions inside slot 131, fixed to structure 13, preferably by screws.

In the lower part of slot 131, fixed to structure 13 preferably by screws, there is a base 24, adapted to support setting device 2 and all its parts.

Setting device 2 also comprises a safety cone 26, positioned in the vicinity of reference portion 21, fixed to support structure 13 preferably by screws, and able to permit the correct insertion and facilitate the exit of the fuse of setting device 2. Furthermore, such cone 26 determines the adjustment of the position of setting device 2 permitted by the mechanism for recovering errors.

The rotary movement of setting portion 22 and of reference portion 21 transmitted by belts is facilitated by a plurality of bearings 23, preferably ball-bearings.

The rotation method of reference portion 21 and of setting portion 22 for the setting step is similar to the known aforementioned method.

Motors 33 are preferably positioned in the vicinity of the control device, for example under such device, fixed to the lower face of motor plate 11, preferably by screws.

The control device comprises said movable equipment 31, actuator 34 for vertical movement and actuator 35 for horizontal movement, adapted to perform the handling of the setting mechanism in its entirety.

Movable equipment 31 comprises a support plate 310, preferably metallic, to which support structure is fixed as aforementioned, with at least two pulleys 332, preferably toothed and connected with motors 33, adapted to rotate setting device 2 by means of belts 331, and at least two belt-tensioners 334, adapted to tension belts 331.

Pulleys 332 and belt-tensioners 334 are positioned in the upper face of supporting plate 310, inside slot 131' of structure 13.

Belt-tensioners 334 are fixed through a pin so to make said belt-tensioners 334 idle in rotation around the vertical axis of such pins.

Slot 131' assures a protection of pulleys 332 and belt-tensioner 334, as the height of such components is lower than the thickness of said slot 131' of support structure 13.

Said pulleys 332 are connected to motors 33 by means of corresponding shafts 333, which are grooved to assure the transmission, on which such pulleys can translate.

Said shafts 333, passing through corresponding holes for shafts 111 comprised in motor plate 11 preferably have a length equal to the length of columns 14.

Columns 14 pass through movable equipment 31, in particular through support plate 310, by means of a plurality of holes. They perform the function of guiding the movement along the vertical axis of equipment 31 itself.

On each shaft 333 at least one control device 71 for rotation is present, which is preferably provided with an encoder for example optical, adapted to determine, with a reduced uncertainty, the angular variations.

Said control devices 71 are preferably positioned on such shafts 333 on limit plate 12.

The movements detected by the control device for rotation 71 are movements which are transferred from motors 33 by means of belts 331, to setting device 2 for setting the fuses.

The vertical movement of movable equipment 31 occurs due to the actuator of a vertical movement 34, comprising at least one oleo-dynamic device 341, formed by two pistons, opposed and integrated in a single structure, and a braking device, adapted to reduce the elongation of such pistons and avoid too heavy shocks between structure 13 and limit plate 12. Such braking device permits to slow down the elongation speed of the pistons, once having passed a certain extension of the pistons themselves.

The vertical movement, along axis "Z" of plate 310, and of all the components fixed to the same, permits to the setting mechanism to move along its vertical axis, so permitting its placing on the fuse for setting the same, and for a subsequent disengagement.

Such actuator 34 lifts the setting device 2 along axis "Z", bringing it preferably in the disengaged position, so avoiding to interfere with the movements of the ammunition when passing to other operating steps of the firearm.

Actuator 34 of the vertical movement is preferably placed in a slot 112, comprised in motor plate 11 and placed on a side of plate 11 itself, in order not to interfere with movable equipment 31, and with the devices comprised inside slot 131', for handling setting device 2.

Said actuator 34, by means of hooking portions 342 preferably realized through forks, is fixed both to movable equipment 31, in particular to plate 310, and to motor plate 11, preferably through screws.

In the following descriptive and non limitative embodiment of the present invention, the braking device consists in a suitable cavity, made inside the structure of the cylinder in which the two pistons are contained. The end of one of the pistons, before support structure 13 meets its mechanical stop, enters in such cavity by forcing the exit of the oil through the aperture formed between the two engaged elements.

Such solution is possible due to a suitable working tolerance of the two cylindrical elements: a male one (the end of the piston) and a female one (the cavity in the cylinder).

Such cavity in the cylinder introduces a damping element in the equation of the motion, so reducing the elongation speed of the piston beyond a certain elongation of the same.

Limit plate 12 advantageously comprises at least one detecting device, fixed to the lower face of such plate 12, adapted to determine the position of support structure 13 and also of equipment 31, during its vertical movement, by signaling the approach of the limit condition in the setting mechanism.

The actuator 35 of horizontal movement is adapted to move along axis "X" the setting mechanism, by sliding it along at least one longitudinal guide 42, preferably fixed to the structure of firearm 5, positioned for example on support flange 52.

The setting mechanism is retracted from the actuator 35 of horizontal movement, in order to avoid to hinder the mechanical movements comprised in the firearm.

Said actuator 35 comprises an hydraulic organ 351, fixed at an end to a fork, preferably through a pin, which is fixed to the structure of firearm 5.

The actuator of horizontal movement 35 is preferably actuated for disengaging setting device 2, by bringing the setting mechanism in a disengaged position, preferably a retracted one, in order to make it inoperative.

The setting mechanism is brought in such position for example during the eventual missing of a shot of the cartridge with the possible new storing step of an ammunition, for example in a magazine, in order not to interfere with such steps.

Said actuator 35 at the other end is fixed to a "U-shaped flange 352" associated to motor plate 11 of the support structure.

Such hydraulic organ 351 is preferably provided with a piston, the extension of which permits to the entire structure of the setting mechanism to perform a horizontal movement along axis "X".

Flange 352 comprises vertical slots 353 in which the pins fixed to organ 351 slide.

Flange 352 slides, due to sleds on which it is fixed, with respect to motor plate 11, on at least one track of said plate, longitudinally along elongation "X"-axis of hydraulic organ 351 (not shown in Figure). The mechanism for recovering errors permits to reduce the clearances along "X"-axis through at least one preferably helical recovery spring 41, centered both on flange 352 and on motor plate 11.

In the embodiment shown in the Figures, two springs 41 are present, fixed to motor plate 11, and to the two arms of flange 352.

The union between the actuator of vertical movement 34 and the actuator of horizontal movement 35 permits to reduce the dimensions of the mechanism, permitting to place such setting mechanism in narrow positions, such as under movable shield 51, but maintaining therefore the flexibility and the reliability of the mechanism.

The mechanism for recovering errors, in addition to springs 41, comprises a plurality of sledges 44 which slide on a plurality of guides adapted to permit the movement in "XY"-plane, in particular longitudinal guide 42, adapted to permit the movements along longitudinal "X"-axis of the setting mechanism, at least one transversal guide 43, adapted to permit the transversal movements along "Y"-axis.

Said recovery mechanism permits to the setting mechanism to position always in axis with the cartridge, by recovering the misalignment errors of various centimeters, which are useful in the case in which the firearm is subjected to movements and stresses, which can cause a wrong positioning of the cartridge for its setting step.

Figure 9:
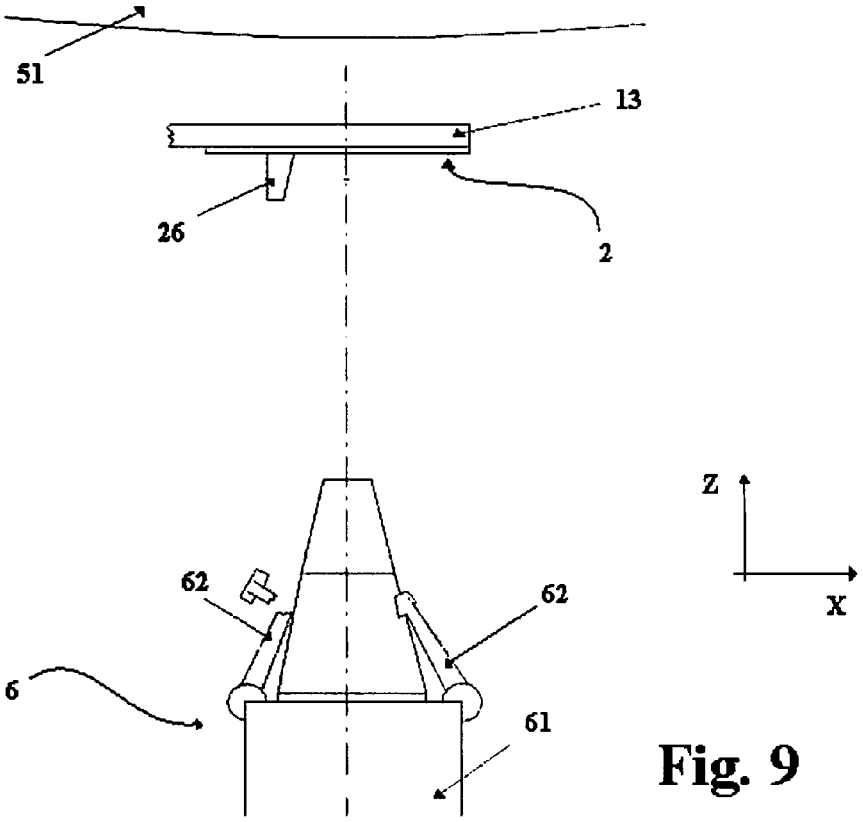
FIG. 9 shows the positioning of the setting device with respect to the cartridge kept in position by the mechanism for retaining cartridges.

The setting mechanism also performs another safety mechanical function, in case of failures of the retaining mechanism of cartridges 6, such as for example the breaking of a lifter 62, as seen in FIG. 9.

In the even remote case in which retaining mechanism 6 does not work, the setting mechanism must act as a damping device of the motion of ammunition.

For such reason, in the project of the setting mechanism, it is noted that support structure 13 and setting device 2 can absorb without damage the energy connected with the arrival of the ammunition.

The present function of mechanical safety is preferably used also during the use of other types of cartridges, which do not need a mechanical setting step of the fuse.

In this latter case, the setting mechanism is kept in a waiting position, by acting through the actuator of vertical movement 34.

The present invention assures the operation of the setting mechanism also in critical conditions, or when applied to a ship with difficult sea conditions (for example sea force 6), by reducing the errors, according to MIL-STD-810C and MIL-STD-167B rules.

The actuation and piloting of motors 33, in addition to all other electronic devices implemented in such setting mechanism, are managed by a central control unit (not shown), which also drives the actuators able to handle the setting mechanism.

Further non illustrated embodiments in the Figures provide for the positioning of motors 33 on the upper face of motor plate 11, by eliminating the presence of shafts 333.

A further alternative embodiment provides for the removal of columns 14 and of limit plate 12, by making in a different way the detecting device, for example by fixing it directly on the structure of firearm 5.

A further embodiment provides that motors 33 move integral with the motor plate, so permitting the removal of shafts 333.

REFERENCE NUMBERS

Motor plate 11
Holes for shafts 111
Slot for actuator 112
Limit plate 12
Support structure 13
Slots 131
Columns 14
Setting device 2
Reference portion 21
Setting portion 22
Bearings 23
Base 24
Cover 25
Safety cone 26
Movable equipment 31
Support plate 310
Motors 33
Belts 331
Pulleys 332
Transmission shafts 333
Belt-tensioners 334
Actuator for vertical movement 34
Oleo-dynamic device 341
Hooking portions 342
Actuator for horizontal movement 35
Hydraulic organ 351
Flange 352
Vertical slots 353
Recovery spring 41
Longitudinal guide 42
Transversal guide 43
Sled 44
Firearm structure 5
Movable shield 51
Support flange 52
Carriage 53
Mechanism for retaining cartridges 6
Loading arm 61
Lifters 62
Device for controlling rotation 71

The invention claimed is:

1. Mechanism for setting a fuse, applied to the structure of a firearm, comprising:

a fuse setter, for programming said fuse, said fuse setter being fixed to a supporting structure and comprising a reference portion and a fuse-setting portion, which turn about a longitudinal axis of the fuse and adapted to set the fuse of a cartridge, a supporting structure comprising a motor plate, and two motors fixed to the motor plate, the motors rotating the fuse setter;

said supporting structure supporting a device for controlling the position of the fuse setter, formed by moving equipment, by an actuator of vertical movement, and by an actuator of horizontal movement, said actuators being adapted for movement along a horizontal axis of the supporting structure, along a vertical axis of the moving equipment for positioning the fuse setter with respect to the cartridge, the cartridge being kept in a pre-set position;

a control device controlling rotation of the fuse setter and adapted to determine angular variation transferred from the motors to the fuse setter.

2. Mechanism according to claim 1, wherein said fuse-setting mechanism comprises an error-recovery mechanism for correct positioning of the fuse setter, in the case of misalignment of the cartridge from the ideal axis, in the plane defined by the longitudinal axis and a transverse axis.

3. Mechanism according to claim 1, wherein the supporting structure of the fuse-setting mechanism comprises and an end-of-travel plate, facing and set on top of the motor plate, the moving equipment moves vertically between the fuse setter and the end-of-travel plate, the motor plate and the end-of-travel plate being located at a distance and kept in said position by a plurality of columns fixed with respect to one another.

4. Mechanism according to claim 3, wherein the columns pass through the moving equipment, to guide movement of the moving equipment along the vertical axis.

5. Mechanism according to claim 1, wherein the actuator of horizontal movement is configured for moving the fuse-setting mechanism along the horizontal axis, causing the fuse-setting mechanism to slide along at least one longitudinal guide fixed to the structure of the firearm so that the fuse-setting mechanism will be retracted, preventing movements of further mechanisms in the firearm from being hampered.

6. Mechanism according to claim 5, wherein the actuator of horizontal movement retracts the fuse-setting mechanism during the possible abortion of the firing of the cartridge and the possible step of re-depositing of an ammunition in a military store so as not to hamper said operations.

7. Mechanism according to claim 1, wherein the fuse setter is positioned within a slot of the supporting structure.

8. Mechanism according to claim 1, wherein the fuse setter further comprises a safety cone, positioned in the vicinity of the reference portion, fixed to the supporting structure, adapted to enable correct entry and facilitate exit of the fuse into/from the fuse setter, said cone determining adjustment of the position of the fuse setter enabled by the error-recovery mechanism.

9. Mechanism according to claim 1, wherein the cartridges are kept in a pre-set position by a cartridge-retention mechanism.

10. Mechanism according to claim 9, wherein in the case of malfunctioning of the retention mechanism, said fuse-setting mechanism performs a mechanical safety function by acting as a device for damping motion of ammunition.

11. Mechanism according to claim 1, wherein said control device comprises an encoder.

12. Mechanism for setting a fuse, applied to the structure of a firearm, comprising:

a fuse setter, for programming said fuse, said fuse setter being fixed to a supporting structure and comprising a reference portion and a fuse-setting portion, which turn about a longitudinal axis of the fuse and adapted to set the fuse of a cartridge, said fuse-setting mechanism comprising a supporting structure supporting a device for controlling the position of the fuse setter, formed by moving equipment, by an actuator of vertical movement, and by an actuator of horizontal movement, said actuators being adapted for movement along a horizontal axis of the supporting structure, along a vertical axis of the moving equipment for positioning the fuse setter with respect to the cartridge, the cartridge being kept in a pre-set position;

wherein said fuse-setting mechanism comprises an error-recovery mechanism for correct positioning of the fuse setter, in the case of misalignment of the cartridge from the ideal axis, in the plane defined by the longitudinal axis and a transverse axis;

wherein the error-recovery mechanism comprises at least one recovery spring, adapted to limit play along the longitudinal axis, a plurality of slides, which slide on a plurality of guides and are adapted to enable movement of the fuse-setting mechanism in the plane.

13. Mechanism according to claim 12, wherein the guides comprise at least one longitudinal guide, adapted to enable movements of the fuse-setting mechanism along the longitudinal axis, and at least one transverse guide, adapted to enable transverse movements along the transverse axis.

14. Mechanism for setting a fuse, applied to the structure of a firearm, comprising:

a fuse setter, for programming said fuse, said fuse setter being fixed to a supporting structure and comprising a reference portion and a fuse-setting portion, which turn about a longitudinal axis of the fuse and adapted to set the fuse of a cartridge, said fuse-setting mechanism comprising a supporting structure supporting a device for controlling the position of the fuse setter, formed by moving equipment, by an actuator of vertical movement, and by an actuator of horizontal movement, said actuators being adapted for movement along a horizontal axis of the supporting structure, along a vertical axis of the moving equipment for positioning the fuse setter with respect to the cartridge, the cartridge being kept in a pre-set position;

wherein the moving equipment comprises a supporting structure, fixed to the supporting plate, at least two pulleys, connected to the motors, adapted for rotation of the fuse setter via corresponding belts, and at least two belt-tensioners, adapted to tension the belts.

15. Mechanism according to claim 14, wherein the pulleys are connected to the motors via transmission shafts, grooved for ensuring transmission, wherein said pulleys can translate on said shafts.

16. Mechanism for setting a fuse, applied to the structure of a firearm, comprising:

a fuse setter, for programming said fuse, said fuse setter being fixed to a supporting structure and comprising a reference portion and a fuse-setting portion, which turn about a longitudinal axis of the fuse and adapted to set the fuse of a cartridge, said fuse-setting mechanism comprising a supporting structure supporting a device for controlling the position of the fuse setter, formed by moving equipment, by an actuator of vertical movement, and by an actuator of horizontal movement, said actuators being adapted for movement along a horizontal axis of the supporting structure, along a vertical axis of the moving equipment for positioning the fuse setter with respect to the cartridge, the cartridge being kept in a pre-set position;

wherein the actuator of vertical movement comprises an oleodynamic device comprising two pistons, opposed to one another and incorporated in a single structure, and a braking device adapted to slow down extension of said pistons;

said actuator raises the fuse setter along the axis, preventing the movements of ammunition from being hampered in the passage to the other functioning operations of the firearm.

17. Mechanism according to claim 16, wherein the braking device is a purposely provided slot, the slot being made within the structure of the cylinder of the structure that encloses the two pistons, the end of one of the pistons, before the supporting structure encounters the mechanical rest enters said slot, forcing exit of oil through the gap created between the two elements that become engaged with one another.

18. Mechanism for setting a fuse, applied to the structure of a firearm, comprising:

a fuse setter, for programming said fuse, said fuse setter being fixed to a supporting structure and comprising a reference portion and a fuse-setting portion, which turn about a longitudinal axis of the fuse and adapted to set the fuse of a cartridge, said fuse-setting mechanism comprising a supporting structure supporting a device for controlling the position of the fuse setter, formed by moving equipment, by an actuator of vertical movement, and by an actuator of horizontal movement, said actuators being adapted for movement along a horizontal axis of the supporting structure, along a vertical axis of the moving equipment for positioning the fuse setter with respect to the cartridge, the cartridge being kept in a pre-set position;

wherein the supporting structure of the fuse-setting mechanism comprises a motor plate, fixed to the motor plate are at least two motors, for rotating the fuse setter, and an end-of-travel plate, facing and set on top of the motor plate, the moving equipment moves vertically between the fuse setter and the end-of-travel plate, the motor plate and the end-of-travel plate being located at a distance and kept in said position by a plurality of columns fixed with respect to one another.

* * * * *